US012049835B2

(12) United States Patent
Aimo Boot et al.

(10) Patent No.: US 12,049,835 B2
(45) Date of Patent: Jul. 30, 2024

(54) LASH ADJUSTER WITH HYDRAULIC LASH ASSEMBLY AND MECHANICAL LASH ASSEMBLY

(71) Applicant: Eaton Intelligent Power Limited, Dublin (IE)

(72) Inventors: Marco Aimo Boot, Turin (IT); Matteo Raffaele Costantini, Turin (IT); Luigi Lia, Turin (IT); Piero Parmeggiani, Massa (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/998,405

(22) PCT Filed: May 13, 2021

(86) PCT No.: PCT/EP2021/025180

§ 371 (c)(1),
(2) Date: Nov. 10, 2022

(87) PCT Pub. No.: WO2021/228436

PCT Pub. Date: Nov. 18, 2021

(65) Prior Publication Data

US 2023/0175420 A1 Jun. 8, 2023

Related U.S. Application Data

(60) Provisional application No. 63/024,992, filed on May 14, 2020.

(51) Int. Cl.

| | |
|---|---|
| ***F01L 1/20*** | (2006.01) |
| ***F01L 1/22*** | (2006.01) |
| ***F01L 1/24*** | (2006.01) |

(52) U.S. Cl.
CPC ..... *F01L 1/20* (2013.01); *F01L 1/205* (2013.01); *F01L 1/22* (2013.01); *F01L 1/2405* (2013.01)

(58) Field of Classification Search
CPC ..... F01L 1/20; F01L 1/205; F01L 1/22; F01L 1/2405

(Continued)

(56) References Cited

U.S. PATENT DOCUMENTS 3,542,001 A * 11/1970 Line ..... F01L 1/2405 123/90.43
6,039,017 A * 3/2000 Hendriksma ..... F01L 1/2405 123/90.19

(Continued)

FOREIGN PATENT DOCUMENTS

DE 102014220174 A1 7/2015
GB 2006373 A 5/1979

OTHER PUBLICATIONS

International Search Report issued in corresponding application No. PCT/EP2021/025180 dated Aug. 23, 2021, 4 pages.

(Continued)

*Primary Examiner* — Jorge L Leon, Jr.
(74) *Attorney, Agent, or Firm* — Pearne & Gordon LLP

(57) ABSTRACT

A lash adjuster can include a hydraulic lash assembly, a mechanical lash assembly, and a check assembly. The hydraulic lash assembly can include a body, a top plunger, a leak down plunger, and the check assembly between the body and the leak down plunger. The mechanical lash assembly can be between the top plunger and the leak down plunger. The mechanical lash assembly can include a shim abutting the top plunger, a spacer, and a spring pressing against the spacer and the shim to form a gap between the top plunger and the leak down plunger. The lash adjuster can (Continued)

include the spring pressing directly against the spacer and directly or indirectly against the shim.

15 Claims, 4 Drawing Sheets

(58) Field of Classification Search
USPC ..... 123/90.52, 90.55
See application file for complete search history.

(56) References Cited

U.S. PATENT DOCUMENTS

2008/0066704 A1* 3/2008 Cecur ..... F01L 1/24
123/90.52
2020/0370448 A1* 11/2020 Rezkalla ..... F01L 13/0005

OTHER PUBLICATIONS

Written Opinion issued in corresponding application No. PCT/EP2021/025180 dated Aug. 23, 2021, 6 pages.

* cited by examiner

LASH ADJUSTER WITH HYDRAULIC LASH ASSEMBLY AND MECHANICAL LASH ASSEMBLY

CROSS-REFERENCE TO RELATED APPLICATIONS

This is a National Stage application of PCT international application PCT/EP2021/025180 filed on May 13, 2021, which claims priority to U.S. Provisional Patent Application No. 63/024,992, filed May 14, 2020, each of which is incorporated by reference herein in its entirety.

FIELD

This application provides a lash adjuster comprising a mechanical lash assembly and a hydraulic lash assembly.

BACKGROUND

A hydraulic lash adjuster (HLA) is a device that can be used for maintaining a specified valve clearance in an internal combustion engine. The HLA can compensate some tolerance variation and thermal deformation of the cylinder head and exhaust valves. But, there are situations, such as low temperature or start-up operation, where the HLA can permit the reopening of a valve. This unintended reopening needs to be prevented.

Prior attempts to combine a mechanical lash feature within a hydraulic lash adjuster have resulted in complex manufacture and an inability to select-fit during installation. One example can be seen in U.S. Pat. No. 3,542,001, where a stop ring, stop groove, stop surface, and diameter changes to a compensator assembly combine to result in a device with high tolerance stack up and little ability to adjust for minor differences in lash during assembly. Another example can be seen in U.S. Pat. No. 6,039,017 where either a simple lash spring (curved washer) or a complicated lash spring (sleeved "sandwich type spring") again present an inability to adjust for minor differences in lash during assembly.

SUMMARY

The methods disclosed herein overcome the above disadvantages and improves the art by way of a lash adjuster comprising mechanical and hydraulic components. Drop in assembly is improved over the prior art. Limited use of diameter changes to the leak down plunger can be had in some embodiments. Select-fitting can be accomplished with ease to limit and reduce scrap and increase parts re-use.

A lash adjuster can comprise a hydraulic lash assembly, a mechanical lash assembly, and a check assembly. The hydraulic lash assembly can comprise a body, a top plunger, a leak down plunger, and the check assembly between the body and the leak down plunger. The mechanical lash assembly can be between the top plunger and the leak down plunger. The mechanical lash assembly can comprise a shim abutting the top plunger, a spacer, and a spring pressing against the spacer and the shim to form a gap between the top plunger and the leak down plunger.

The lash adjuster can comprise the spring pressing directly against the spacer and directly against the shim. The spring can be configured to flex against the shim. An optional retaining clip can be pressed against the leak down plunger and configured to retain the spring against the spacer.

The leak down plunger can comprise a shouldered bore forming a check assembly seat on a first side and a smooth bore on a second side. The spacer can be seated in the smooth bore.

The lash adjuster can comprise the spring pressing directly against the spacer and indirectly against the shim. The spacer can comprise a base pressed against the spring and an extension pressing against the shim.

The leak down plunger can comprise a shouldered bore forming a check assembly seat on a first side and a spring seat in a grooved bore on a second side. A clip can be in a groove of the grooved bore. The spring can push the spacer against the clip and against the shim. The shim can be configured to reciprocate in the leak down plunger, and the clip can form a travel stop for the shim.

For injection filling of the lash adjuster, it can be configured with a through passage from the top plunger, through the mechanical lash assembly, and to the check assembly.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Figure 1:
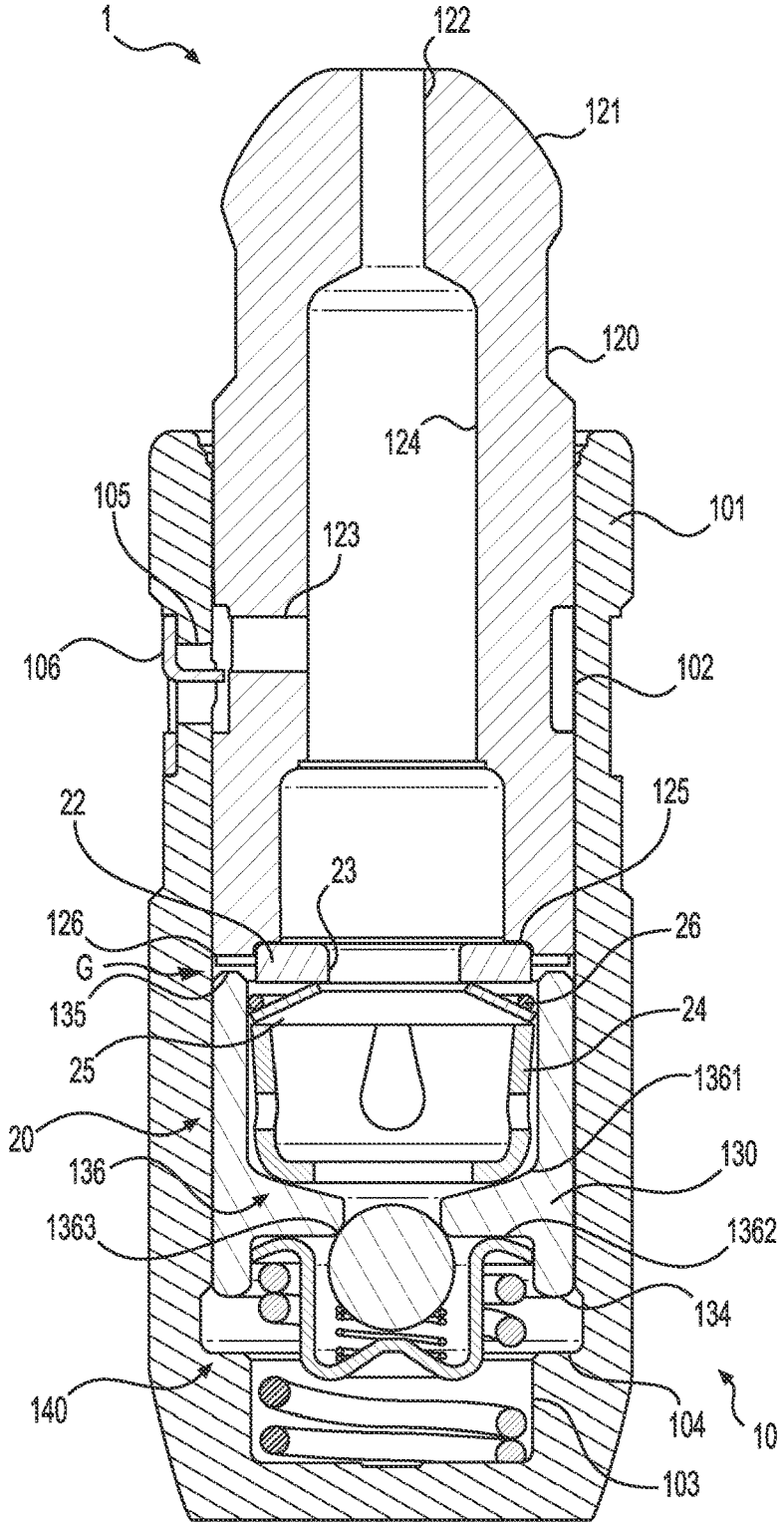
FIG. 1 is a cross-section view of a first lash adjuster.

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

A lash adjuster 1, 2 can comprise both a hydraulic lash assembly 10 and means for mechanical lash. The means for mechanical lash can comprise a regulating shim 22, a spring 25, 250, and a spacer 24, 240.

The lash adjuster 1, 2 can comprise a top plunger 120, 1120, a leak down plunger 130, 1130, and a mechanical lash assembly 20, 200 between the top plunger 120, 1120 and the leak down plunger 130, 1130. A body 101 can house the leak down plunger 130, 1130 between the top plunger 120, 1120 and a check assembly 140. The hydraulic lash assembly 10 can comprise the top plunger 120, 1120, the leak down plunger 130, 1130, the body 101 and the check assembly 140. The top plunger 120, 1120 and leak down plunger 130, 1130 can comprise different dimensions. The top plunger 120, 1120 and leak down plunger 130, 1130 can comprise different shapes.

There are situations where an Hydraulic Lash Adjuster ("HLA") can permit the reopening of a valve during ramp-up. For example, when the oil in the system is cold and viscous, it is difficult for the check assembly of the HLA to perform as intended. But, as the oil heats up, the HLA responsiveness improves.

The improvements herein prevent the undesired reopening by including a mechanical lash assembly 20, 200 in a lash adjuster 1, 2 that also includes a hydraulic lash assembly 10. The lash adjuster 1, 2 is a device that can be used for maintaining a zero or other predetermined valve clearance in an internal combustion engine. The lash adjuster 1, 2 is able to compensate tolerance variations and the thermal deformation of the cylinder head and exhaust valves. The compensation can be within a range. The range can be set by using a combination of a mechanical lash assembly and a hydraulic lash assembly. The two can coexist in the same device and can convey the benefits of each during the operation of the engine in which they are installed.

As an example of the applicability of the mechanical lash assembly 20, 200, it is helpful to consider engine start-up, when the engine heats rapidly as it ramps up. During the engine start or in some specific conditions or with the engine at low temperature, the lash adjuster 1, 2 can be modified to rapidly compensate for the thermal elongation of the exhaust valves. The modifications prevent the exhaust valves from opening from the thermal elongation. Then, the exhaust valves open as commanded by the valve actuators and do not open from the thermal elongation occurring as the engine system ramps up. Start-up is one exemplary operating condition where mechanical lash assemblies are advantageous.

The hydraulic lash assembly 10 can comprise the addition of mechanical lash assembly 20, 200 to set a gap G between the top plunger 120, 1120 and the leak down plunger 130, 1130. The hydraulic lash assembly 10 can house the mechanical lash assembly 20, 200 for shared lash adjustment functionality. So, an elastic element and regulation shim can also be housed between the top plunger and the leak down plunger. Then, while the oil is cold and viscous, a mechanical lash can be supplied in the gap G with the mechanical lash assembly 20, 200. But, as the oil heats up, the check assembly 140 in the hydraulic lash assembly 10 improves its functionality. Both mechanical and hydraulic lash can be provided once the oil is hot. It can be optional to set the gap so that mechanical lash is the dominant contributor during cold temperatures and start-up and the hydraulic lash is the dominant contributor during hot oil operation. Or, the mechanical lash assembly can contribute throughout lash adjuster operation with the additive contribution of the hydraulic lash adjuster. So, as the valve and other engine components heat up and elongate, the mechanical lash assembly 20, 200 can take up lash in the gap G, it also responding to thermal expansion and contraction. The gap G can be larger in cold conditions and can become smaller as the lash adjuster 1, 2 heats up. As the oil heats up, the hydraulic lash assembly 140 can collapse to take up lash. So, it can be said that the lash is additive.

The modifications can be applied to hydraulic lash adjusters including 2-piece hydraulic lash adjusters. Several examples are set forth below. The examples comprise aspects that can be used together or individually as illustrated to improve the functionality of the HLA.

A lash adjuster 1, 2 can comprise a hydraulic lash assembly 10 and a mechanical lash assembly 20, 200. The hydraulic lash assembly 10 can comprise a body 101, a top plunger 120, a leak down plunger 120, and a check assembly 140.

The body 101 can be configured to seat in an engine block and position the lash adjuster 1, 2 to interface with a push tube, a rocker arm, a roller finger or other valve actuation device for purposes of taking up lash. Body 101 can comprise a plunger compartment 102, a check spring compartment 103, and a limiting step 104. A supply port 105 is formed through the body 101 to enable fluid pressure control to the lash adjuster 1, 2. An optional travel clip 106 can include a protrusion through the supply port 105 to position the top plunger 120, 1120. Optional and alternative leak down paths and glands can be formed in the body 101 or top plunger 120, 1120 or leak down plunger 130, 1130 to form fluid pressure pathways.

Top plunger 120, 1120 can comprise a ball end 121, 1121 so that a socket of a rocker arm or switching roller can pivot thereon, or the ball end 121, 1121 can be replaced with a socket to receive a push tube. A pin port 122, 1122 can be formed through the ball end 121, 1121. Pin port 122, 1122 can permit insertion of an injection device for pre-filling the lash adjuster 1, 2. A though passage can be formed from the top plunger 120, 1120, through the mechanical lash assembly 20, 200, and to the check assembly 140 so that the injection device can be inserted through to the check 141 of the check assembly 140. Alternatively, pin port 122, 1122 can seat a jiggle pin or the like.

Top plunger 120, 1120 can also comprise a fluid port 123, 1123 for supplying fluid to the liquid compartment 124, 1124 within the top plunger 120, 1120. Liquid compartment 124, 1124 can be stepped or smooth; it can comprise controlled orifices or leak down pathways; or it can comprise a funnel 1127 or other fluid distribution device. An optional shim step 125, 1125 can be formed in the lash end 126, 1126 for positioning a shim 22. Shim step 125, 1125 in top plunger 120, 1120 can form a travel limit for the shim 22.

Leak down plunger 130, 1130 can be enclosed in the body 101 and a travel limit end 134, 1134 can slide to and away from limiting step 104. Leak down plunger 130, 1130 can also form a gap G for taking up lash. Gap G can be formed between lash end 126, 1126 of top plunger 120, 1120 and lash limit end 135, 1135 of leak down plunger 130, 1130. Heat expansion and contraction, as mentioned above, can be compensated for in the gap G.

A mechanical lash assembly 20, 200 can take up lash and can also expand and contract in response to thermal fluctuations. Mechanical lash assembly 20, 200 can be placed between the top plunger 120, 1120 and the leak down plunger 130, 1130. Mechanical lash assembly 20, 200 can comprise the shim 22 abutting the top plunger 120, 1120. Shim can be a washer or the like insert that can be select-fit so that if a larger gap G is needed, a thicker shim can be selected. A shim port 23 can be formed through the shim 22 to facilitate the through passage. The shim 22 can be used to maintain the gap G under hot or cold operating conditions. Then, the lash adjuster 1, 2 cannot collapse past the shim 22 whether hot or cold.

Returning to the leak down plunger 130 1130, shim 22 can be sized to reciprocate in a shouldered bore 131, 1131. Pressure on top plunger 120, 1120 can push shim 22 into the shouldered bore 131, 1131. The pressure on top plunger 120, 1120 can be enough to close gap G so that lash limit end 135, 1135 and lash end 126, 1126 contact. Then the check assembly 140 can be pushed upon for providing its functionality.

Check assembly 140 can be installed between the body 101 and the leak down plunger 130, 1130. Check assembly 140 can seat in check compartment 103 so that a cage spring 144 can push on a cage 143. Cage 143 can comprise a check spring 142 pressing a check 141 against a shoulder 136, 1136. Check 141 can be a ball, blank, slab or other obstruction that can block fluid flow through check port 1363, 11363 but for motions of the lash adjuster 1, 2 that enable filling of the high pressure chamber formed between the leak down plunger 130, 1130 and check compartment 103. Cage 143 can be pressed against a check side 1362, 11362 of shoulder 136, 1136. A seat side 1361, 11362 of shoulder 136, 1136 can seat aspects of mechanical lash assembly 20, 200.

So, in addition to shim 22, mechanical lash assembly 20 can comprise a spacer 24. Spacer 24 can set the height of spring 25. A spring 25 can press against the spacer 24 and the shim 22 to form the gap G between the top plunger 120 and the leak down plunger 130. The spring 25 can be a cup spring, wave spring, leaf spring or other compliant mechanism configured to press directly against the spacer 24 and directly against the shim 22. An indirect arrangement can also be had by placing, for example, one or more washer or other intervening structure or positioning expedient between the spacer 24 and spring 25. A shim side 252 of spring 25 can abut the shim 22 and a spacer side 251 of spring 25 can abut the spacer 24 for direct contact and force transfer. Spring 25 can be a cup spring configured to flex against the shim 22.

When pressure is placed on shim 22 from top plunger 120, the pressure transfers to spring 25, which flexes. The pressure collapses gap G. When pressure is released on top plunger 120, the flexed spring 25 releases its stored force to push the shim 22 away to expand the gap G. The mechanical lash assembly 20 can optionally comprise a retaining clip 26, such as a snap ring, bushing, pressed ring, or the like. The retaining clip 26 can be pressed against the leak down plunger 130 and configured to retain the cup spring or other spring 25 against the spacer 24.

The spacer 24 can comprise a funnel seated in the leak down plunger 130. It is expedient to have the leak down plunger 130 as easily formed as possible through casting or machining. So, it is desirable to form the leak down plunger 130 to comprise a shouldered bore 131 forming the check assembly seat 132 on a first side 1362 of the shoulder 136 and a smooth bore 133 on a second side 1361 of the shoulder 136. The spacer 24 can be seated in the smooth bore 133. Smooth bore can be free of grooves or glands to easy drop-in assembly of the mechanical lash assembly 20. It could be possible to form a lip, or retaining groove, or clip or washer arrangements, but the illustrated embodiment comprises the smooth bore 133.

The spacer 24 being a funnel shape, the sidewalls 242 can be tapered to flex and grip the smooth bore 133. Slits 244 can be formed in the sidewalls 242 to facilitate the flexing and provide leakdown paths. Sidewalls 242 can also be formed of different heights for select-fitting techniques so that different spacers 24 can be used for setting different sizes of gaps G to take up lash as needed in the system. Part re-use for the lash adjuster 1 is greatly improved because of the select-fit enabled by the spacer 24 and shim 22. Base 241 can comprise a spacer port 243 for the through passage. A spring seat 246 can be formed on the sidewalls 242 to receive the spring 25.

Figure 3:
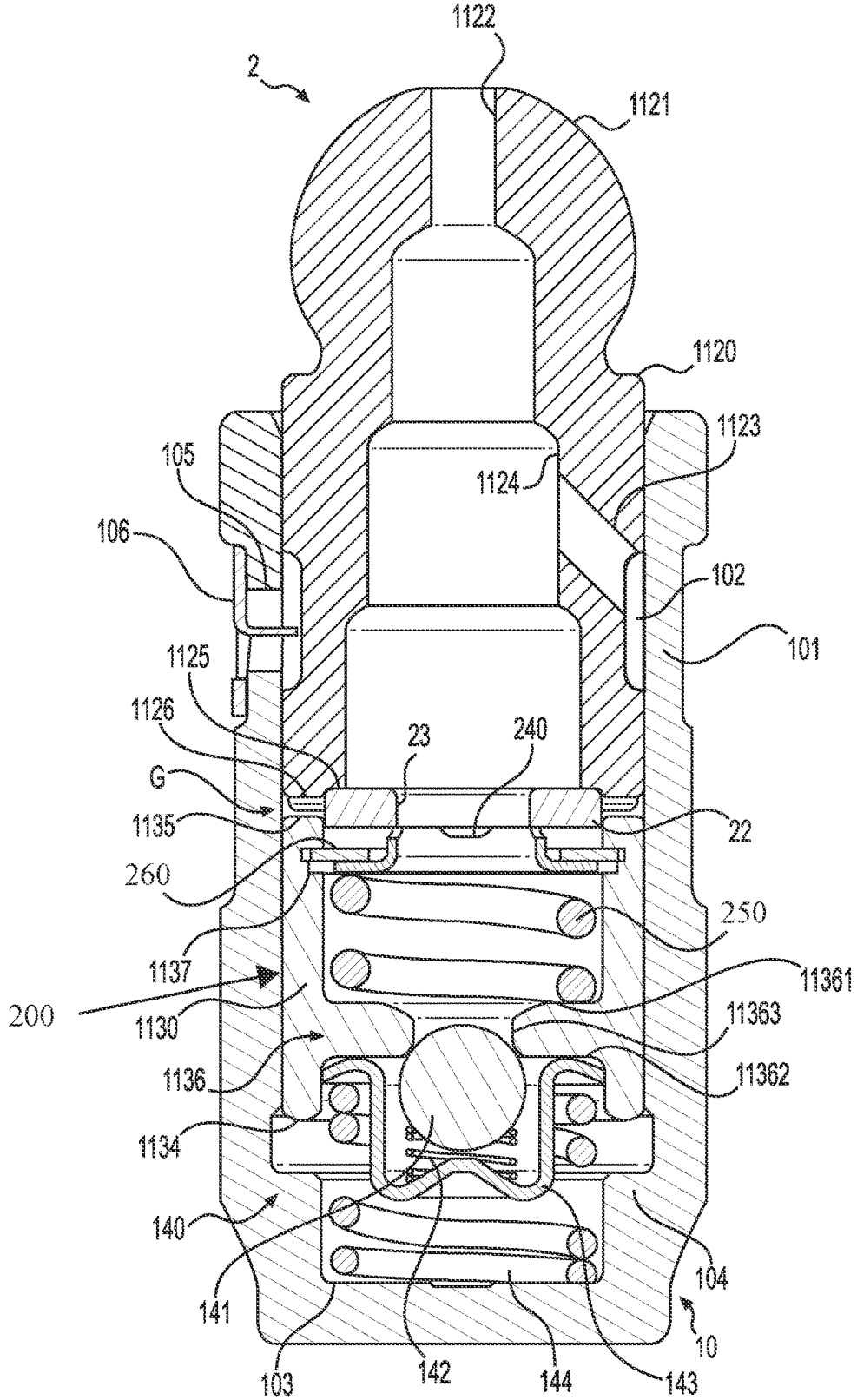
FIG. 3 is a cross-section view of a second lash adjuster.
Figure 4:
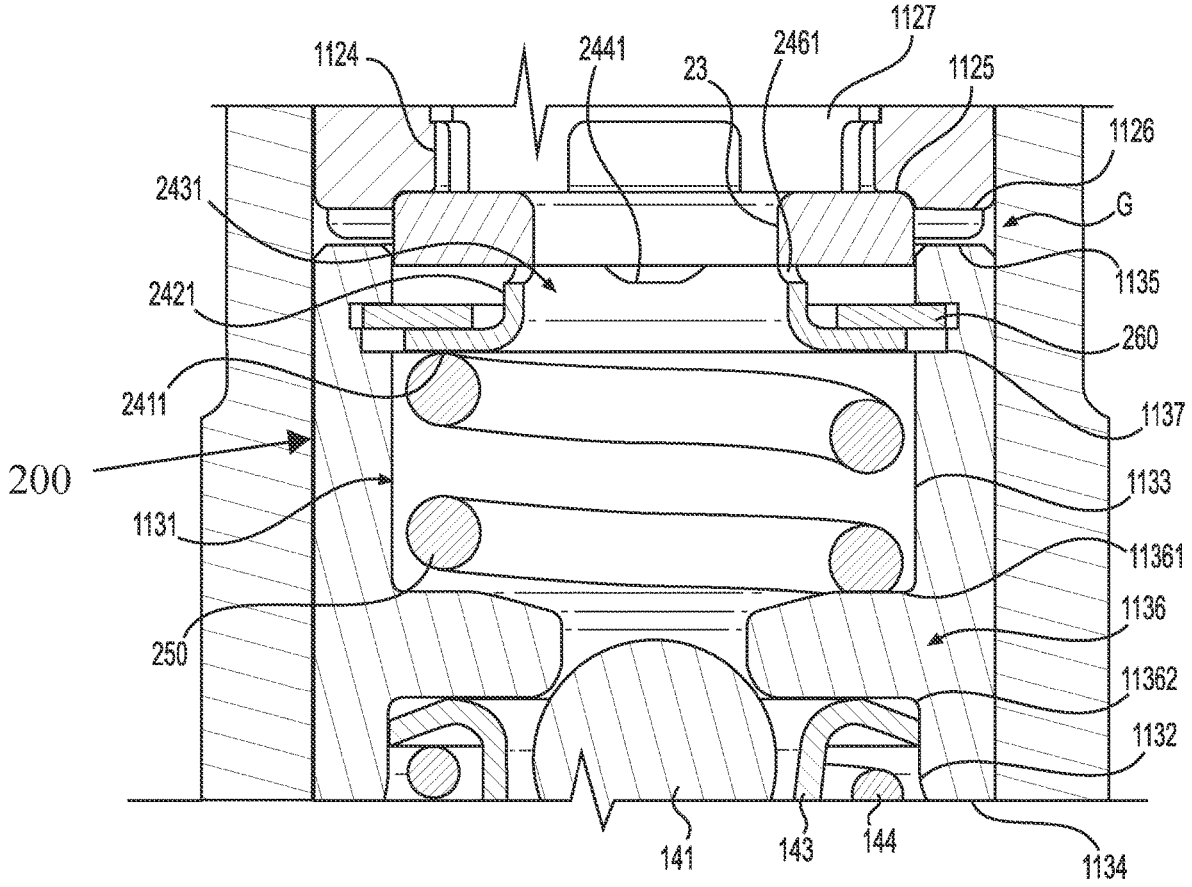
FIG. 4 is a view of a portion of the lash adjuster of FIG. 3.

As shown in FIGS. 3 & 4, in addition to shim 22, mechanical lash assembly 200 can comprise spacer 240. This spacer 240 also facilitates part re-use because its sidewalls 2421 can be selected of heights that can be controlled to set gap G. Slits 2441 can be included in the sidewalls 2421 for fluid circulation and a shim seat 2461 can be included. A spacer port 2431 can be formed in the base 2411 for the through passage.

Spring 250 can abut seat side 11361 of shoulder 1136 and can be biased to push base 2411 towards shim 22. Spring 250 can comprise a coil spring, leaf spring, wave spring, or the like compliance device for receiving pressure from the top plunger 1120, which moves shim 22, which presses shim seat 2461. Spring 250 can press against the spacer 240 and the shim 22 to form a gap G between the top plunger 1120 and the leak down plunger 1130. As illustrated, spring 250 presses directly against the spacer 240 and indirectly against the shim 22, as the spring force 250 transfers through the spacer 240 to the shim 22.

The spacer 240 comprises a base 2411 pressed against the spring 250. The sidewalls 2421 constitute an extension pressing against the shim 22. The base 2411 can comprise a diameter that reciprocates in the shouldered bore 1131. The leak down plunger 1130 comprises the shouldered bore 1131 forming the check assembly seat in the check side (first side) 11362 of shoulder 1136 and a spring seat in a grooved bore 1133 on a (second side) seat side 11361 of shoulder 1136. The shouldered bore 1131 can further comprise a clip 260 in a groove 1137 of the grooved bore 1133. The spring 250 can push the spacer 240 against the clip 260 and against the shim 22. The base 2411 can be restricted by the clip 260 to restrict the size of gap G and thereby prevent pump of the lash adjuster 2. Groove 1137 can be sized for clip 260 to reciprocate therein for added lash. So, clip 260 can be configured to reciprocate in the groove 1137. Optionally, the shim 22 can be configured to reciprocate in the grooved bore 1133 of leak down plunger 1130 but the clip 260 forms a travel stop for the shim 22. The gap G can expand and collapse in response to pressure or pressure release on the top plunger 1120 and energy storage in the spring 250.

Figure 2:
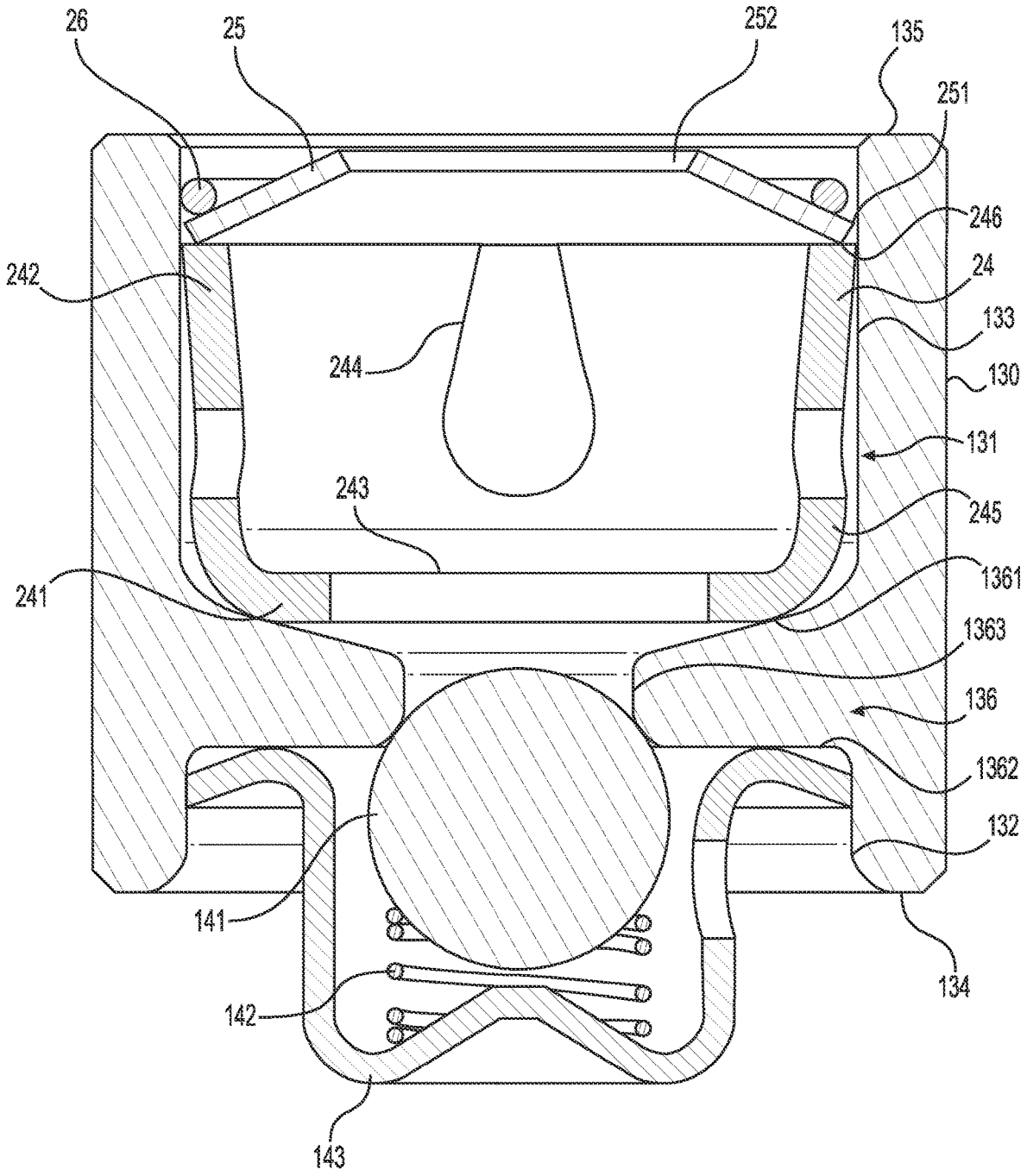
FIG. 2 is a view of a portion of the lash adjuster of FIG. 1.

Similar to the embodiment of FIGS. 1 & 2, the lash adjuster 2 of FIGS. 3 & 4 can comprise the shim 22 configured to reciprocate in the leak down plunger 1130 to close the gap G to take up lash and then be biased by the spring 250 to open the gap G.

Other implementations will be apparent to those skilled in the art from consideration of the specification and practice of the examples disclosed herein.

What is claimed is:

1. A lash adjuster, comprising:
- a hydraulic lash assembly, comprising:
  - a body;
  - a top plunger disposed within the body;
  - a leak down plunger disposed within the body, the leak down plunger being a separate component from the top plunger; and
  - a check assembly arranged between the body and the leak down plunger; and
- a mechanical lash assembly arranged between the top plunger and the leak down plunger, the mechanical lash assembly comprising:
  - a shim abutting the top plunger;
  - a spacer disposed within the leak down plunger, the spacer being a separate component from the shim and the leak down plunger; and
  - a spring biased between the spacer and the shim so as to form a gap between the top plunger and the leak down plunger.

2. The lash adjuster of claim 1, wherein the spring presses directly against the spacer and directly against the shim.

3. The lash adjuster of claim 2, wherein the spacer comprises a funnel seated in the leak down plunger.

4. The lash adjuster of claim 2, wherein the spring is a cup spring configured to flex against the shim.

5. The lash adjuster of claim 4, further comprising a retaining clip pressed against the leak down plunger, the retaining clip configured to retain the cup spring against the spacer.

6. The lash adjuster of claim 1, wherein the leak down plunger comprises a shouldered bore including a shoulder defining a check assembly seat on a first side of the shoulder and a smooth bore on a second side of the shoulder, and wherein the spacer is seated in the smooth bore.

7. The lash adjuster of claim 1, wherein the spring presses directly against the spacer and indirectly against the shim.

8. The lash adjuster of claim 7, wherein the spacer comprises a base pressed against the spring and an extension pressed against the shim.

9. The lash adjuster of claim 7, wherein the leak down plunger comprises a shouldered bore including a shoulder defining a check assembly seat on a first side of the shoulder and a spring seat in a grooved bore on a second side of the shoulder.

10. The lash adjuster of claim 9, further comprising a clip arranged in a groove of the grooved bore, wherein the spring biases the spacer against the clip and against the shim.

11. The lash adjuster of claim 10, wherein the clip is configured to reciprocate in the groove.

12. The lash adjuster of claim 10, wherein the shim is configured to reciprocate in the leak down plunger, and wherein the clip forms a travel stop for the shim.

13. The lash adjuster of claim 1, wherein the shim is configured to reciprocate in the leak down plunger.

14. The lash adjuster of claim 1, wherein the top plunger comprises a travel limit for the shim.

15. The lash adjuster of claim 1, further comprising a through passage from the top plunger, through the mechanical lash assembly, and to the check assembly.

* * * * *